US005544472A

United States Patent [19]

Koskinen et al.

[11] Patent Number: 5,544,472

[45] Date of Patent: Aug. 13, 1996

[54] METHOD FOR PACKAGING OF BULK GOODS INTO A UNIT-LOAD PACKAGE AND A UNIT-LOAD PACKAGE FOR BULK GOODS

[75] Inventors: Erkki Koskinen, Pori, Finland; Tom Stenmark, Waterloo, Belgium

[73] Assignee: Oy W. Rosenlew AB, Pori, Finland

[21] Appl. No.: 302,668

[22] PCT Filed: Mar. 8, 1993

[86] PCT No.: PCT/FI93/00080

§ 371 Date: Oct. 25, 1994

§ 102(e) Date: Oct. 25, 1994

[87] PCT Pub. No.: WO93/17911

PCT Pub. Date: Sep. 16, 1993

[30] Foreign Application Priority Data

| | | | |
|---|---|---|---|
| Mar. 10, 1992 | [FI] | Finland | 921043 |
| Dec. 7, 1992 | [FI] | Finland | 925555 |

[51] Int. Cl.[6] ..... B65B 11/58

[52] U.S. Cl. ..... 53/449; 53/399; 53/578

[58] Field of Search ..... 53/399, 449, 441, 53/442, 173, 576, 578, 579

[56] References Cited

U.S. PATENT DOCUMENTS

| | | | |
|---|---|---|---|
| 3,529,717 | 9/1970 | McDougal | 206/65 |
| 3,670,880 | 6/1972 | Burleson et al. | 53/449 |
| 4,154,045 | 5/1979 | Christensson | 53/432 |
| 4,172,152 | 10/1979 | Carlisle | 53/449 |
| 4,215,520 | 8/1980 | Heinzer et al. | 53/173 |
| 4,546,593 | 10/1985 | Lasscock | 53/441 |
| 4,597,189 | 7/1986 | Cutrara | 53/442 |
| 4,879,861 | 11/1989 | McAdams | 53/442 |
| 5,005,335 | 4/1991 | Yourgalite et al. | 53/399 |
| 5,354,569 | 10/1994 | Brown et al. | 53/449 |

FOREIGN PATENT DOCUMENTS

| | | |
|---|---|---|
| 0122864 | 10/1984 | European Pat. Off. . |
| 0180379 | 5/1986 | European Pat. Off. . |
| 0338181 | 10/1989 | European Pat. Off. . |
| 45143 | 1/1964 | Finland . |
| 3453/71 | 12/1971 | Finland . |
| 773460 | 5/1978 | Finland . |
| 159990 | 4/1981 | Norway . |
| 467195 | 7/1967 | Switzerland . |

*Primary Examiner*—John Sipos
*Assistant Examiner*—Gene L. Kim
*Attorney, Agent, or Firm*—Steinberg, Raskin & Davidson, P.C.

[57] ABSTRACT

The invention concerns a method for packaging of bulk goods into a unit-load package and a unit-load package for bulk goods. The unit-load package consists of an inner package (11) and of an outer package (16). The inner package (11) is an inner sack made of a flexible material, which has been placed on a base (13) for the time of filling with bulk goods, whereby, during the filling, the inner package (11) is shaped substantially as parallelepiped. The outer package (16) is an outer package which is made of a plastic material and which surrounds the inner package (11) tightly and gives it adequate stability.

12 Claims, 2 Drawing Sheets

Fig. 1
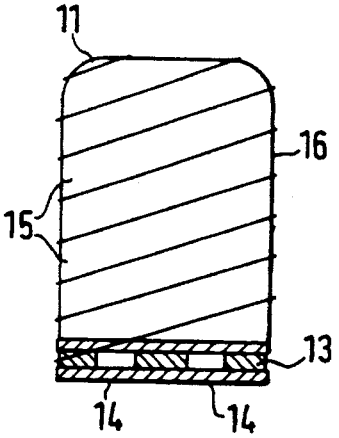
Fig. 2
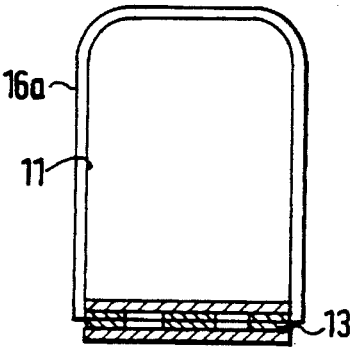
Fig. 3
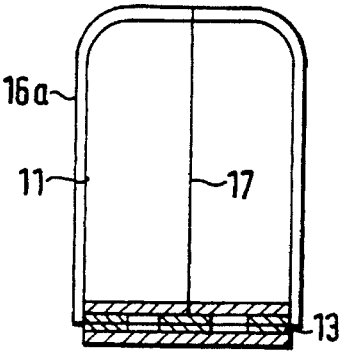
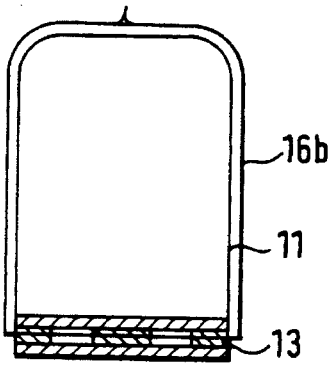
Fig. 4
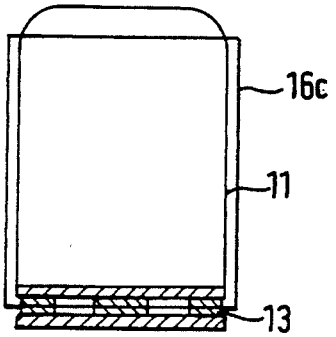
Fig. 5

METHOD FOR PACKAGING OF BULK GOODS INTO A UNIT-LOAD PACKAGE AND A UNIT-LOAD PACKAGE FOR BULK GOODS

Method for packaging of bulk goods into a unit-load package and a unit-load package for bulk goods.

BACKGROUND OF THE INVENTION

The invention concerns a method for packaging of bulk goods into a unit-load package.

The invention also concerns an unit-load package for bulk goods, which package consists of an inner package and an outer package.

For packaging, storage, and transportation of bulk goods, box packages or other packages of rigid construction are used, which are placed on a base (usually a pallet). The box packages consist of boxes of corrugated board. The box of corrugated board is, as a rule, provided with an inner sack. When filled such a package has a quadrangular shape and, thus, utilizes the transportation base maximally, even though the package as such is expensive.

Unit-load sacks are also used for packaging, storage, and transportation of bulk goods. A unit-load sack is less expensive than a box package, but its drawback is its round shape when filled, whereby it utilizes the transportation base less efficiently than a box package does.

OBJECTS AND SUMMARY OF THE INVENTION

The object of the present invention is to provide a method for packaging of bulk goods into a resilient package and a resilient package for bulk goods which, when filled, obtains a substantially quadrangular shape and in which, as the base, it is possible to use standard pallets (e.g. EUR, FIN pallets). In this way, it is possible to combine the maximal utilization of space by a box package with the favorable cost of a resilient package. At the same time, the recycling of the used package can be arranged better, because no sorting is required, but the resilient package is recycled as such, and the standard pallet is returned to circulation. In the case of a box package, it is necessary to separate the box, the inner sack, and the base, and the recycling must be arranged through three separate systems.

A further object of the invention is to provide a method for packaging of such bulk goods into a resilient package whose inner friction is very low.

The method in accordance with the invention for packaging of bulk goods into a unit-load package is characterized in that:

(a) an inner package made of a resilient material and provided with a reinforcement structure is placed on a base, (b) the inner package is filled with bulk goods, whereby, during the filling, the inner package obtains substantially a form of a parallelepiped, and (c) the inner package and the base are surrounded with an outer package of plastic material, whereby a stable transportation package is formed.

The unit-load package in accordance with the invention for bulk goods is characterized in that the inner package is an inner sack made of a flexible material and provided with a reinforcement structure, which sack has been placed on a base for the time of filling with bulk goods, preferably by suspending or supporting it above the base and that the outer package is an outer package which is made of a plastic material and which surrounds the inner package tightly and gives it adequate stability.

In the method of the invention, it has been realized to use a unit-load package which consists of an inner package made of a flexible inexpensive material and of a surrounding outer package, which gives the unit-load package adequate robustness. As the flexible material of the inner package whose rigidity is relatively low, for example, plastic films, paper, or fabrics can be used. For the time of the filling with bulk goods, the resilient package is suspended or supported above a suitable base, such as a pallet. After the filling with bulk goods, the inner package, which may be provided with a reinforcement structure, is bound to the base, e.g., by means of a tightening foil so that a robust unit, i.e. a unit-load package, is formed. The width of the tightening foil is not an essential factor. The width of the tightening foil may be a conventional width, such as about 500 mm, but, as the tightening foil, it is also possible to use even a full-width tightening foil of a width equal to the height of the entire inner package. Instead of a tightening foil, it is, of course, also possible to use a tightening hood or a shrinking hood.

The reinforcement structure may be a separate reinforcement structure, or a part of the inner package may operate as a reinforcement structure at the same time.

It is a characteristic of the unit-load package in accordance with the invention that the inner package of the unit-load package must endure the strains imposed by the filling stage and that the measure of the circumference of the inner package filled with bulk goods should not increase substantially during the filling stage. It should be noticed that, during the filling, the inner package may become somewhat wider, i.e. change its shape and receive a quadrangular shape, which can then later be easily wrapped into a tightening foil so as to produce the ultimate unit-load package.

The unit-load package in accordance with the invention permits recycling of used resilient package materials. Moreover, after emptying of the unit-load package, the pallet used for the unit-load package can be stored and re-used.

A unit-load package in accordance with the invention that is filled with bulk goods is a sufficiently robust and operable unit, which also tolerates storage and transportation very well. The unit-load package in accordance with the invention can be lifted easily, e.g., in connection with storage by lifting the unit-load package by means of the forks of a fork-lift truck by using the openings in the pallet.

The inner package, the outer package, and the load base form a unit which can be stacked easily and which is not deformed substantially during stacking and storage.

Even though, during packaging of bulk goods of very low inner friction, the inner package itself obtains the shape of a parallelepiped because of its reinforcement structure provided in the inner package, the stability of the inner package alone often remains inadequate in view of the subsequent step, the surrounding of the inner package with the outer package of plastic material, and therefore the handling properties of the ultimate package, such as stacking quality and stability, do not always become optimal.

In a preferred embodiment of the invention, the inner package is subjected to negative pressure after the filling and before the inner package is closed. In such a case, the inner package is pressed tightly around the bulk goods, and therefore the stability of the inner package is increased and the subsequent step can be carried out readily.

When the inner package has been surrounded with plastic material, which is placed tightly against the inner package, a stable transportation package has been obtained. The stability of the unit-load package then remains good even if the negative pressure produced into the inner package were lost in the course of time. In such a case, at least the following concrete advantages are obtained in comparison with the prior-art vacuum packages.

For the inner package, it is possible to use normal polyolefin plastics, such as polyethylenes, and it is not necessary to use expensive barrier plastics, whose recycling is, moreover, difficult.

If a small hole is produced into the inner package during transportation and handling, the stability of the unit-load package is not deteriorated thereby, because the plastic material that surrounds the inner package, preferably a pre-stressed tightening foil, provides the necessary stability.

In an embodiment of the method of the invention, it is possible to use a separate outside formwork construction. In such a case, it is advantageous that the separate outside formwork construction is of the same measures as the transport base, because, then, the inner package fully complies with the measures of the transport base.

It is one of the most remarkable advantages of the present invention that the unit-load package in accordance with the invention can be manufactured out of a quantity of material that is substantially less than the material of a conventional unit-load sack because the lifting capacity required by the safety coefficient is not needed, which is the case with unit-load sacks provided with lifting loops.

The invention will be described in detail with reference to some preferred embodiments of the invention illustrated in the figures in the accompanying drawings.

BRIEF DESCRIPTION OF THE DRAWINGS

FIG. 1 is a schematic side view of a preferred embodiment of a unit-load package produced by the method of the invention.

FIG. 2 is a schematic side view of a second preferred embodiment of a unit-load package produced by the method of the invention.

FIG. 3 is a schematic side view of a third preferred embodiment of a unit-load package produced by the method of the invention.

FIG. 4 is a schematic side view of a fourth preferred embodiment of a unit-load package produced by the method of the invention.

FIG. 5 is a schematic side view of a fifth preferred embodiment of a unit-load package produced by the method of the invention.

DETAILED DESCRIPTION OF THE PREFERRED EMBODIMENTS

Figure 6:
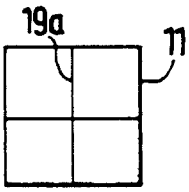
FIG. 6 is a top view of a preferred embodiment of the reinforcement structure in the inner package of a unit-load package in accordance with the invention.

In the embodiment shown in FIG. 1, the inner package 11 is placed on a suitable base, such as a pallet 13. The lifting openings provided in the pallet 13 are denoted with the reference numeral 14. The inner package 11 is filled with bulk goods, whereupon the inner package 11 filled with bulk goods is surrounded by winding a tightening-foil band 15 around it. In this way, the outer package 16 is formed, which surrounds the inner package 11 and gives the unit-load package adequate stability.

The embodiment shown in FIG. 2 differs from the embodiment of FIG. 1 in the respect that, in the embodiment of FIG. 2, the inner package 11 is surrounded by a full-width tightening foil 16*a*.

The embodiment shown in FIG. 3 is in the other respects the same as that shown in FIG. 2, except that, in the embodiment of FIG. 3, the full-width tightening foil 16*a* is provided with a seam 17.

In the embodiment of FIG. 4, the inner package 11 filled with bulk goods is surrounded by a tightening or shrink hood 16*b*, which constitutes the outer package of the unit-load package.

In the embodiment shown in FIG. 5, the inner package 11 filled with bulk goods is surrounded by a so-called tightening or shrink sock 16*c*, which constitutes the outer package of the unit-load package.

Figure 7:
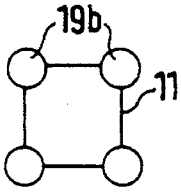
FIG. 7 is a top view of a second preferred embodiment of the reinforcement structure in the inner package of a unit-load package of the invention.
Figure 8:
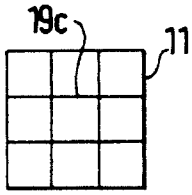
FIG. 8 is a top view of a third preferred embodiment of the reinforcement structure in the inner package of a unit-load package of the invention.
Figure 9:
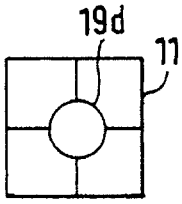
FIG. 9 is a top view of a fourth preferred embodiment of the reinforcement structure in the inner package of a unit-load package of the invention.
Figure 10:
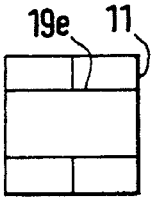
FIG. 10 is a top view of a fifth preferred embodiment of the reinforcement structure in the inner package of a unit-load package of the invention.
Figure 11:
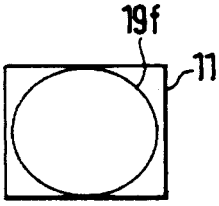
FIG. 11 is a top view of a sixth preferred embodiment of the reinforcement structure in the inner package of a unit-load package of the invention.
Figure 12:
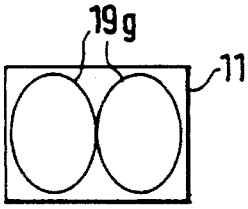
FIG. 12 is a top view of a seventh preferred embodiment of the reinforcement structure in the inner package of a unit-load package of the invention.
Figure 13:
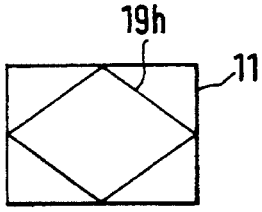
FIG. 13 is a top view of an eighth preferred embodiment of the reinforcement structure in the inner package of a unit-load package of the invention.

In the unit-load package in accordance with the invention, a separate reinforcement structure is used. The reinforcement structure is fitted, in relation to the inner package 11, in the ways shown, e.g., in FIGS. 6 to 13. In the embodiment shown in FIG. 6, the inner package 11 is provided with a cross-shaped reinforcement structure 19*a*. In the embodiment of FIG. 7, there are tubular reinforcement structures 19*b* at the corners of the inner package 11. In the embodiment of FIG. 8, the inner package 11 is provided with a net-shaped reinforcement structure 19*c*. In the embodiment of FIG. 9, the inner package 11 is provided with a tubular reinforcement structure 19*d*, which is placed substantially in the middle area and which is supported on the walls of the inner package 11. In the embodiment of FIG. 10, the inner package 11 is provided with a rectangular reinforcement structure 19*e*, which is supported on the inner package 11 from two of its opposite sides. In the embodiment of FIG. 11, the inner package 11 is provided with a substantially circular reinforcement structure 19*f*. In the embodiment of FIG. 12, the inner package 11 is provided with two substantially circular reinforcement structures 19*g*. In the embodiment of FIG. 13, the inner package 11 is provided with a reinforcement structure 19*h* shaped as a rhomb. The shape of the reinforcement structure is not critical. What is essential is that the reinforcement structure should help the inner package 11 to retain a shape substantially similar to a parallelepiped.

In the method in accordance with the invention for packaging of bulk goods into a unit-load package, the inner package 11, which is made of a resilient material and which is provided with a reinforcement structure 19*a*, 19*b*, 19*c*, 19*d*, 19*e*, 19*f*, 19*g*, or 19*h*, is placed on a base 13. The inner package 11 is filled with bulk goods, whereby, during the filling, the inner package 11 obtains substantially the shape of a parallelepiped. The inner package 11 and the base 13 are surrounded with an outer package 16, 16*a*, 16*b*, or 16*c* of plastic material, whereby a stable transportation package is formed. According to the basic idea of the invention, the inner package 11 filled with bulk goods is subjected to negative pressure, whereby the inner package 11 is pressed tightly around the bulk goods. Whereupon, the inner package 11, which has been filled with bulk goods and subjected to negative pressure, is surrounded with an outer package 16 made of plastic material.

Figure 14A:
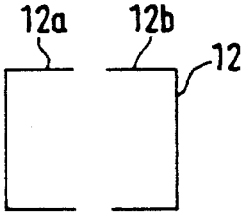
FIGS. 14A to 14G are a schematic illustration viewed from above of the various steps in one embodiment of the method of the invention.
Figure 14B:
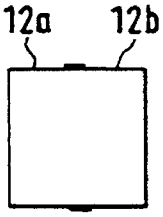
Figure 14C:
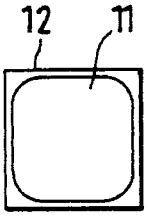
Figure 14D:
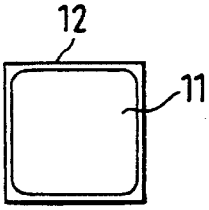
Figure 14E:
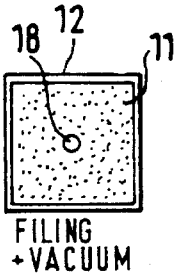
Figure 14F:
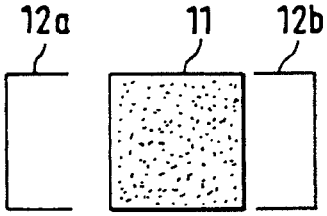
Figure 14G:
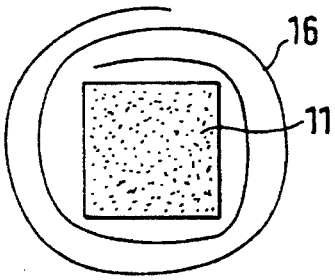

In the embodiment illustrated in FIGS. 14A to 14G, the formwork construction used in the method of the invention is denoted generally with the reference numeral 12. The positioning of the inner package 11 with respect to the base 13 has been achieved by means of the formwork construction 12. In this embodiment, the formwork construction 12 consists of formwork halves 12*a* and 12*b*. In the situation as shown in FIG. 14A, the substantially U-section formwork halves 12*a* and 12*b* are separate from one another. In the next step of the method, the formwork halves 12*a* and 12*b* are displaced towards one another so that they form a formwork construction 12 shaped as a parallelepiped. In the method stage as shown in FIG. 14C, the inner sack 11 is placed into the formwork construction 12 (the reinforcement structure in the sack is not shown). FIG. 14D illustrates the process step in which the inner sack 11 is filled with bulk goods, whereby the inner sack 11 receives a substantially quadrangular shape inside the formwork construction 12. In the stage of the method illustrated in FIG. 14E, the inner sack 11 filled with bulk goods is subjected to negative pressure. In this embodiment, the inner sack 11 communicates with a source of negative pressure, which is not shown through a tubular duct 18. In the stage of the method shown in FIG. 14F, the formwork halves 12*a* and 12*b* of the formwork construction 12 are shifted apart from one another, whereby the inner sack 11, which has been filled with bulk goods and subjected to negative pressure, retains its substantially quadrangular shape. In the stage of the method shown in FIG. 14G, the formwork construction 12 has been removed completely, and the inner sack 11, filled the bulk goods and subjected to negative pressure, is surrounded with the outer package 16 of plastic material, whereby a stable transportation package is formed.

Thus, in a general embodiment of the method of the invention, a separate formwork construction is not needed necessarily, because the inner package 11 can be placed onto the base 13, e.g., by suspending. If desired, it is possible to use a separate outside formwork construction 12 in the method of the invention, as is shown in the embodiment illustrated in FIGS. 14A to 14G. In such a case, it is preferable that the separate outside formwork construction 12 is of the same size as the transport base 13, because then the inner package 11 complies precisely with the measures of the transport base 13.

Figure 15:
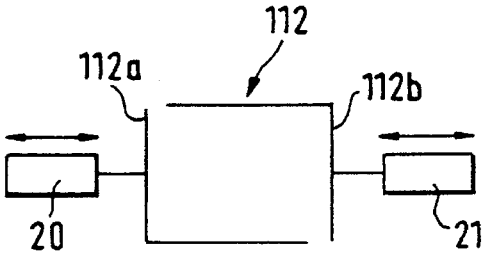
FIG. 15 is a schematic top view of a second preferred embodiment of the formwork employed in the method as illustrated in FIGS. 14A to 14G.

The formwork construction illustrated in the embodiment of FIG. 15 is denoted generally with the reference numeral 112. The formwork construction 112 consists of substantially L-section formwork halves 112*a* and 112*b*. A pneumatic cylinder 20 is fitted to displace the formwork half 112*a*, and a pneumatic cylinder 21 is fitted to displace the formwork half 112*b*, respectively.

Above, only some preferred embodiments of the invention have been described, and it is obvious for a person skilled in the art that numerous modifications can be made to said embodiments within the scope of the inventive idea stated in the accompanying patent claims.

We claim:

1. Method for packaging bulk goods into a unit-lead package, comprising the steps of:

displacing two formwork halves towards one another so that they form a closed formwork construction shaped as a parallelepiped and having a hollow interior;

placing an inner package made of a flexible resilient material into said interior of said closed formwork construction;

filling said inner package with bulk goods, whereby said inner package obtains substantially a quadrangular shape inside said formwork construction;

subjecting said inner package, which has been filled with the bulk goods, to a negative pressure;

shifting said formwork halves apart from one another, whereby the inner package, which has been filled with the bulk goods and subjected to said negative pressure, retains said substantially quadrangular shape; and surrounding said inner package with an outer package made of plastic material to provide stability.

2. Method according to claim 1, wherein said negative pressure is communicated with said inner package through a tubular duct.

3. Method according to claim 1, wherein said negative pressure is applied after said filling of said inner package with said bulk goods.

4. Method according to claim 1, wherein said formwork halves are substantially U-shaped.

5. Method according to claim 1, wherein said formwork halves are substantially L-shaped.

6. Method according to claim 1, further comprising the step of suspending said inner package above said base.

7. Method according to claim 1, further comprising the step of supporting said inner package above said base.

8. Method according to claim 1, further comprising the step of forming said outer package by winding a tightening-foil band around said inner package and said base.

9. Method according to claim 1, further comprising the step of said outer package out of a full-width tightening foil.

10. Method according to claim 1, further comprising the step of forming said outer package out of a full-width tightening foil that is provided with a seam.

11. Method according to claim 1, further comprising the step of forming said outer package out of a tightening or shrink hood.

12. Method according to claim 1, further comprising the step of forming said outer package out of tightening or shrink sock.

* * * * *